US005612305A

United States Patent [19]

Lewis

[11] Patent Number: 5,612,305

[45] Date of Patent: Mar. 18, 1997

[54] MIXED SURFACTANT SYSTEMS FOR LOW FOAM APPLICATIONS

[75] Inventor: Ronald G. Lewis, Austin, Tex.

[73] Assignee: Huntsman Petrochemical Corporation, Salt Lake City, Utah

[21] Appl. No.: 372,049

[22] Filed: Jan. 12, 1995

[51] Int. Cl.[6] ..... C11D 1/825; C11D 1/70; C11D 1/72; C11D 1/722

[52] U.S. Cl. ..... 510/220; 510/221; 510/226; 510/228; 510/367; 510/422; 510/506; 510/535

[58] Field of Search ..... 252/174.22, 174.21, 252/DIG. 1, DIG. 10, 170; 510/220, 221, 226, 228, 367, 422, 506, 535

[56] References Cited

U.S. PATENT DOCUMENTS

| | | | |
|---|---|---|---|
| 2,677,600 | 5/1954 | Young | 23/267 |
| 2,895,916 | 7/1959 | Milenkevich et al. | 252/99 |
| 2,979,528 | 4/1961 | Lundsted | 260/584 |
| 3,036,118 | 5/1962 | Jackson et al. | 260/484 |
| 3,314,891 | 4/1967 | Schmolka et al. | 252/89 |
| 3,359,207 | 12/1967 | Kaneko et al. | 252/99 |
| 3,382,176 | 5/1968 | Jakobi et al. | 252/89 |
| 3,519,379 | 7/1970 | Blomeyer et al. | 8/111 |
| 3,549,539 | 12/1970 | Mallows | 252/99 |
| 3,583,922 | 6/1971 | McClain et al. | 252/99 |
| 3,625,909 | 12/1971 | Berg | 252/153 |
| 3,655,568 | 4/1972 | Zaki et al. | 252/99 |
| 3,741,912 | 6/1973 | Kaneko | 510/222 |
| 3,817,869 | 6/1974 | Ries et al. | 252/99 |
| 3,844,711 | 10/1974 | Daeuble et al. | 8/93 |
| 3,882,038 | 5/1975 | Clayton et al. | 252/164 |
| 3,888,781 | 6/1975 | Kingry et al. | 252/99 |
| 3,899,436 | 8/1975 | Copeland et al. | 252/99 |
| 3,936,386 | 2/1976 | Corliss et al. | 252/99 |
| 3,956,401 | 5/1976 | Scardera et al. | 260/615 B |
| 4,005,027 | 1/1977 | Hartman | 252/95 |
| 4,051,055 | 9/1977 | Trinh et al. | 252/95 |
| 4,051,056 | 9/1977 | Hartman | 252/99 |
| 4,070,298 | 1/1978 | Scardera et al. | 510/228 |
| 4,077,897 | 3/1978 | Gault | 252/99 |
| 4,092,258 | 5/1978 | McLaughlin et al. | 252/99 |
| 4,101,457 | 7/1978 | Place et al. | 252/559 |
| 4,127,496 | 11/1978 | Stokes | 252/102 |
| 4,136,045 | 1/1979 | Gault et al. | 252/135 |
| 4,169,806 | 10/1979 | Davis et al. | 252/99 |
| 4,182,683 | 1/1980 | Irvine et al. | 252/99 |
| 4,188,305 | 2/1980 | Halas | 252/95 |
| 4,207,197 | 6/1980 | Davis et al. | 252/99 |
| 4,223,163 | 9/1980 | Guilloty | 568/618 |
| 4,226,736 | 10/1980 | Bush et al. | 252/135 |
| 4,233,171 | 11/1980 | McLaughlin et al. | 252/99 |
| 4,256,601 | 3/1981 | Sobata et al. | 252/135 |
| 4,263,160 | 4/1981 | Morse | 510/535 |
| 4,272,394 | 6/1981 | Kaneko | 252/99 |
| 4,306,987 | 12/1981 | Kaneko | 252/99 |
| 4,317,940 | 3/1982 | Scardera et al. | 568/625 |
| 4,405,490 | 9/1983 | Maas et al. | 252/358 |
| 4,411,810 | 10/1983 | Dutton et al. | 252/99 |
| 4,427,417 | 1/1984 | Porasik | 23/313 |
| 4,431,559 | 2/1984 | Ulrich | 252/99 |
| 4,446,044 | 5/1984 | Rutkiewic et al. | 252/170 |
| 4,464,281 | 8/1984 | Rapisarda et al. | 252/174.21 |
| 4,511,487 | 4/1985 | Prühs et al. | 252/99 |
| 4,512,908 | 4/1985 | Heile | 252/160 |
| 4,548,729 | 10/1985 | Schmid et al. | 252/174.21 |
| 4,601,844 | 7/1986 | Cilley | 252/95 |
| 4,606,775 | 8/1986 | Robinson et al. | 134/18 |
| 4,714,562 | 12/1987 | Roselle et al. | 252/94 |
| 4,740,327 | 4/1988 | Julemont et al. | 252/103 |
| 4,828,723 | 5/1989 | Cao et al. | 252/8.8 |
| 4,836,951 | 6/1989 | Totten et al. | 252/174.21 |
| 4,839,084 | 6/1989 | Ouhadi et al. | 252/174.21 |
| 4,874,537 | 10/1989 | Peterson et al. | 252/99 |

(List continued on next page.)

FOREIGN PATENT DOCUMENTS

| | | |
|---|---|---|
| 941707 | 2/1974 | Canada . |
| 1031229 | 5/1978 | Canada . |
| 0130678 | 1/1985 | European Pat. Off. . |
| 894027 | 5/1989 | South Africa . |
| 9010356 | 12/1990 | South Africa . |
| 1325645 | 8/1973 | United Kingdom . |
| 1466077 | 3/1977 | United Kingdom . |
| 2116199 | 9/1983 | United Kingdom . |
| 2164350 | 3/1986 | United Kingdom . |
| 2204321 | 11/1988 | United Kingdom . |
| 9103536 | 3/1990 | WIPO . |
| 9103537 | 3/1991 | WIPO . |
| 9106620 | 5/1991 | WIPO . |
| 9114760 | 10/1991 | WIPO . |

OTHER PUBLICATIONS

Abstract of DE 4,116,406–A, Nov. 19, 1992.

Milton J. Rosen, "Surfactants & Interfacial Phenomena," Wiley Interscience, 1978 (no mo. available).

Pletnev, et al., "Heat–Regulated Foaming in Surfactant Solutions," *Journal of Applied Chemistry of the USSR, translated from Russian, Mar. 10, 1984*, Russian Original vol. 56, No. 9, Part 2, Sep. 1983.

Britesil Hydrous Polysilicates, Bulletin 17–107, The PQ Corporation, P. O. Box 840, Valley Forge, PA 19482, undated.

CDB Clearon® Stabilized Dry Chlorinated Compound, 1989 Olin Corporation (no mo. available).

*Chemical Times & Trends*, Oct. 1987.

*Happi* (Household and Personal Products Industry), Dec. 1991.

Sodium Silicates Liquid/Solids, Bulletin 17–103, The PQ Corporation, P. O. Box 840, Valley Forge, PA 19482, undated.

*Primary Examiner*—Ardith Hertzog

*Attorney, Agent, or Firm*—Russell R. Stolle; Ron D. Brown

[57] ABSTRACT

Machine dishwashing detergents are disclosed containing a compatible mixture of a low-foaming nonionic surfactant and a high-foaming nonionic surfactant. Dishes and other utensils are cleaned to a sparkling clean spot-free condition by the machine washing detergent composition of the present invention. The machine dishwashing detergent compositions of the present invention are effective especially in controlling foam encountered upon washing dishes and other utensils encrusted with soils generally encountered on dishes, specifically egg and milk-derived protein soils.

9 Claims, No Drawings

U.S. PATENT DOCUMENTS

| | | | |
|---|---|---|---|
| 4,889,652 | 12/1989 | Sullivan et al. | 252/99 |
| 4,927,555 | 5/1990 | Colarusso, Jr. | 252/99 |
| 4,931,195 | 6/1990 | Cao et al. | 252/8.8 |
| 4,954,283 | 9/1990 | Schmid et al. | 252/135 |
| 4,966,728 | 10/1990 | Hazen | 252/354 |
| 4,973,419 | 11/1990 | Romeo et al. | 252/135 |
| 4,973,423 | 11/1990 | Geke et al. | 252/174.21 |
| 5,259,963 | 11/1993 | Wiedemann | 252/8.6 |
| 5,273,677 | 12/1993 | Arif | 252/174.21 |
| 5,498,378 | 3/1996 | Tsaur et al. | 264/4.4 |

MIXED SURFACTANT SYSTEMS FOR LOW FOAM APPLICATIONS

BACKGROUND OF THE INVENTION

1. Field of the Invention

This invention relates to a surfactant system useful in dishwashing machines, and more particularly to a surfactant system comprising a compatible mixture of at least one uncapped ethoxylated nonionic medium-to-high foaming surfactant and at least one propylene oxide capped nonionic low foaming surfactant. This surfactant system is useful in dishwashing detergents and as rinse aids which have a good wetting and drainage effect on hard surfaces.

2. Background Information

Many cleaning applications require surfactants that are both low foaming and defoaming. Examples include automatic dishwasher detergents, textile processing, paper processing, ore processing and metal cleaning. Here the typical ethoxylated nonionic surfatants must be subjected to a capping process to meet these requirements. Capping reactions with propylene oxide or other suitable chemicals are a costly extra step in the production of these surfactants.

In the art of cleaning compositions for use in cleaning hard surfaces, particularly the art of cleaning tableware and other food-soiled utensils in machine dishwashers, the problem of excessive foam buildup in the machine during operation is the result of high food soil concentrations. The use of alkyl phosphate ester defoamers such as monostearyl acid phosphate as disclosed in U.S. Pat. No. 3,314,891 has largely solved the problem of excessive foam buildup. Prior thereto, machine dishwashing compositions had a tendency to foam excessively and/or leave undesirable spots and streaks on dishes and glassware. The low foaming nonionic surfactants contained in such detergent compositions were ineffective in both removing food soil and providing suitable foam control where the aqueous cleaning solution became contaminated with foam generating protein soils such as egg soil and soil from various milk products.

The generation of such foams is particularly insidious in that the cleaning action of the machine dishwasher depends to a large extent upon the effective suppression of foam generation during operation. Without effective foam suppression, the mechanical cleaning action of the machine dishwasher is reduced as the result of foam buildup in the aqueous cleaning solution. The aqueous washing fluid which is normally impelled against the tableware in the machine dishwasher is less effective in cleaning because it is forced against the tableware at reduced pressure.

An indication of the various kinds of nonionic surfactants utilized in such machine dishwashing compositions can be found in U.S. Pat. Nos. 3,314,891 and 3,359,207. General disclosures of nonionic surfactants can be found in U.S. Pat. Nos. 2,677,600; 2,979,528 and 3,036,118. Low foaming washing and cleaning agents for use in machine dishwashing are also disclosed in U.S. Pat. No. 3,382,176. Machine dishwashing detergent compositions containing a nonphosphate salt builder have been disclosed in British Pat. No. 1,325,645; Canadian Pat. No. 941,707; U.S. Pat. Nos. 3,899,436; 4,127,496 and 4,092,258.

Another method of reducing the foaming tendency of ethoxylated alcohols was to end cap them with an alkyl group. For example, Henkel has a series of patents using capped surfactants to suppress foam. In the following, "EO" is an ethylene oxide residue, "PO" is a propylene oxide residue, "BO" is butylene oxide residue, and "AO" is an alkylene oxide residue. Henkel published patent application ZA 89/4027, 1990 discloses a low foam surfactant composition that produces little foam and good wetting on plastics (especially polycarbonates) and that are recommended for rinse aid applications in automatic dishwashers. The nonionic surfactants used therein included $C_{8-18}$—O—$(EO)_x$—$C_{8-14}$ alone or in combination with one or more of $C_{8-18}$—O—$(EO)_a$—$(PO)_b$—H, $C_{8-18}$—O—$(EO)_c$—$C_{4-8}$ and $C_{8-18}$—O—$(EO)_d$—H, where a=2 to 6, b=3 to 7, c=7 to 12, d=20 to 50 and x=20 to 40. This patent application also discloses the processes for their production. DE 3,928,604 discloses foam-inhibiting alkyl polyglycol ethers for detergents including $C_{8-14}$—O—$(EO)_{2-8}$—$C_{8-10}$ which can be used in mixtures with $C_{8-18}(EO)_{7-10}$—H in ratios of 10:90 to 90:10. Suggested applications are for machine dishwashing detergents. DE 3,935,374 discloses a compound with good anti-foaming activity and is shown by $C_{6-18}$—O—$(EO)_{3-6}$—$C_{4-8}$. These are made with a narrow range molecular weight distribution ethoxylation catalyst. EP 254206 discloses low-foam/foam-depressing surfactant mixtures containing $C_{8-18}$—O—$(EO)_{3-7}$—$C_{4-8}$ and $C_{8-18}$—O—$(EO)_{1-3}$—$(PO)_{3-66}$—H optionally with $C_{16-22}$—O—$(PO)_{1-3}$—H. Henkel patent (DE 4,009,533, 1991) discusses mixtures for laundry applications in the form of: alkyl glucose compounds with R—O—$(EO)_{0-15}$—$(AO)_{1-20}$—OR' with R=$C_{8-22}$ and R'=$C_{1-10}$.

Encolab Inc., U.S. Pat. No. 4,973,423, 1990 claims foam inhibiting additives or low-foam cleaners. The additives are the alkyl end-capped ethoxylated alcohols $C_{6-18}$—O—$(EO)_{2-6}$—$C_{4-8}$ used in conjunction with wetting agents such as nonionic surfactants, including polyglycol ethers of the type obtained by adding ethylene oxide onto alcohols.

Due to the additional processing steps and cost involved in alkyl end-capping, the search continued and still continues for low foaming and defoaming nonionic surfactants which avoid such steps and cost.

Drackett Co., U.S. Pat. No. 4,226,736, 1980 discloses mixtures of surfactants and thickeners to make gel type automatic dishwasher detergents. The surfactant mixtures consist of polypropoxylated polyethoxylated ethylene glycols and $C_{10-18}$—O—$(EO/PO)_{55-80\%}$—H.

Nippon Paint Co., U.S. Pat. No. 4,256,601, 1981 discloses a low foam surfactant with very good foam breaking abilities which is the all para X—Ph—$CR_1R_2$—Ph—$O(AO)_{3-20}$H. This material is mentioned in combination with nonionic substances that have a cloud point less than 40° C. such as alcohol ethoxylates, alkylphenol ethoxylates and block copolymers of the (EO)—(PO)—(EO) type. The weight ratio of the above compound to the nonionics is given as a range of 1.0 to 0.05 up to 1.0 to 5.0.

Sandoz Ltd. patent (Abstracts of GB 2204321-B, 1991 and GB 2204321-A, 1988) discusses biodegradable detergent compositions for cleaning surfaces (metals, plastics, laundry) which in addition to an alkanolamine and sequestering agent include the mixture of a fatty alcohol polyethylene glycol ether and a low foaming nonionic surfactant as represented by: $C_{8-22}$—O—$(EO)_{5-25}$H (2–35%) and $C_{8-22}$—O—$(EO)_{1-12}(PO)_{1-5}$H (0.5–5.0%), respectively. According to GB 2204321-A, 1988, the preferred mixture in the surfactant composition was $C_{12-16}$—O—$(EO)_{5-12}$H and $C_{14}$—O—$(EO)_5$—$(PO)_4$H. In Example 2 thereof, laboratory glassware contaminated with dried blood, brain substance and albumin was immersed in a solution containing from 3 to 5% by weight of a composition containing 12% by weight $C_{12/15}$—O—$(EO)_7$H and 1% by weight $C_{12}$—O—$(EO)_5$—

$(PO)_4$—H for 2 to 3 hours at 80° C. or 12 hours at room temperature. There was no mention of low foam nor defoaming with this combination. The remaining examples dealt with laundry detergents (continuous working process through wash tunnel) and cleaning electronic microcircuits (immersion) and watch cases (ultrasonic treatment).

Henkel published patent application WO 91/03536, 1991 discloses foam-inhibiting additives for low foaming cleansers. These additives are: $C_{12-20}$—O—$(EO)_{2-5}$H where the alkyl group is from a 2-branched even alkanol and optionally mixed with $C_{8-18}$—O—$(EO)_{2-6}$—$(PO)_{3-7}$—H where the alkyl group can be branched or linear. The 2-branched aspect of the ethoxylated alcohol is stressed in part by seizing on the observation that slight structural changes produce significant differences in the properties of nonionic surfactants. For example, DE 3,315,951 and 3,800,493 were compared. The primary differences therebetween were the carbon residue of the alcohol used in each case. In the first, the carbon residue had 8 to 18 carbon atoms and that of the other had 20 to 28 carbon atoms. Surfactants with highly branched chains generally show lower foam heights than isomeric straight-chain materials, except where the length of the hydrophobic group becomes too long for straight-chain compounds to have adequate water solubility for good defoaming (e.g., greater than 16 carbon atoms at 40° C.). See "Surfactants and Interfacial Phenomena" by Milton J. Rosen, p. 212, published by Wiley Interscience (1978). As exemplified in this Henkel patent, the branched portion of the alkyl group ranged from 4 to 8 carbon atoms with the straight portion of the alkyl group ranging from 8 to 12 carbon atoms. Accordingly, this Henkel patent teaches away from straight or unbranched alkyl groups in the ethoxylated alcohol so as to effect a reduction in its foaming tendencies.

Henkel published patent application ZA 90/10,356, 1991 discloses industrial cleaners mainly used for cleaning and passivating in spray-cleaning units in the automotive industry. The industrial cleaners use a combination of surfactants for cleaning hard surfaces and which exhibit low foaming properties from 15° C. to 80° C. and excellent wetting properties without leaving spots and stains. The surfactant combination contains (a) $C_{6-18}$—O—$(EO)_{2-12}$—H and (b) $C_{6-18}$—O—$(EO)_{2-10}$—$(PO)_{2-8}$—H where the weight ratio of (a):(b) is within the range of 10:1 to 1:10. The carbon residue of components (a) and (b) are preferably linear. The surfactant combination may further contain (C) $C_{6-18}$—O—$(EO)_{2-12}$—$C_{-1-8}$.

SUMMARY OF THE INVENTION

This invention utilizes a compatible mixture of at least one linear, uncapped ethoxylated nonionic surfactant and at least one low foam nonionic surfactant capped with propylene oxide, which mixture retains the properties of the low foam component(s) while reducing the overall cost of the useful surfactant system(s).

More particularly, there is provided a low foaming dishwashing composition having:

(a) at least one first nonionic surfactant having a general formula selected from the group consisting of general formula (I)

$$R^1—O—(CH_2CH_2O)_y—H \quad (I)$$

wherein $R^1$ represents a linear alkyl or olefinic group having from about 6 to about 18 carbon atoms and y represents a number ranging from about 3 to about 15, and general formula (II)

$$Np—O—(CH_2CH_2O)_z—H \quad (II)$$

wherein Np is the carbon residue of nonylphenol or octylphenol and z represents a number ranging from about 4 to about 200; and (b) at least one second nonionic surfactant having a general formula selected from the group consisting of general formula (III)

$$R^2—O—(CH_2CH_2O)_m—A^1—H \quad (III)$$

wherein $R^2$ represents a linear or branched alkyl or olefinic group having from about 6 to about 16 carbon atoms, m represents a number ranging from about 3 to about 15, and $A^1$ represents a group having the formula $—(CH_2—CH(CH_3)—O)_q—$, $—(CH(CH_3)—CH_2—O)_r—$ or a combination thereof with q and r each representing a number ranging from 0 to about 30 and the sum of q and r represents a number ranging from about 4 to about 30, and general formula (IV)

$$R^3—O—A^2—(CH_2CH_2O)_n—A^3—H \quad (IV)$$

wherein $R^3$ represents a linear or branched alkyl or olefinic group having from about 6 to about 18 carbon atoms, n represents a number ranging from about 10 to about 25, $A^2$ represents a group having the formula $—(CH_2—CH(CH_3)—O)_t—$, $—(CH(CH_3)—CH_2—O)_u—$ or a combination thereof with t and u each representing a number ranging from 0 to about 15 and the sum of t and u represents a number ranging from about 2 to about 15, and $A^3$ represents a group having the formula $—(CH_2—CH(CH_3)—O)_v—$, $—(CH(CH_3)—CH_2—O)_w—$ or a combination thereof with v and w each representing a number ranging from 0 to about 55 and the sum of v and w represents a number ranging from about 10 to about 55, wherein the components a and b above are compatible with each other. Components a and b are preferably present in a mole ratio a:b ranging from about 95:5 to about 60:40.

Surprisingly, this invention maintains the low foam and defoaming performance needed for a number of low foam applications (e.g. automatic dishwasher detergents, rinse aids) while significantly reducing the cost of the surfactants which form the major functional component(s) of the products used in these applications.

DESCRIPTION OF THE PREFERRED EMBODIMENT

The Surfactant

Compositions of the invention contain from about 2% to about 5%, preferably from about 2% to about 3%, by weight of a compatible mixture of (1) uncapped ethoxylated nonionic surfactants and (2) typical propylene oxide capped low foaming surfactants for use as automatic dishwasher detergents. It has been found that certain of these compatible mixtures perform in automatic dishwasher detergents without the loss of food soil removal and with surprisingly little loss of defoaming performance. Mixtures of this type significantly reduce the overall cost of the surfactants useful for these applications.

We have surprisingly found that compatible mixed nonionic surfactant systems (where at least one surfactant is the typical alcohol-ethoxylate-propoxylate or alcohol-propoxylate-ethoxylate-propoxylate, low foam type and at least one is the typical alcohol-ethoxylate of a moderate-to-high foam generation) afford dishwasher performance, in the area of film generation, equal to or superior to that of the low foam (defoaming) surfactant when used alone. It is further surprising that mixtures of surfactants that contain a major amount of a typical ethoxylated alcohol retain the low foam and defoaming properties of the more expensive capped low foaming surfactants and thus show equivalent or superior performance in applications like automatic dishwasher detergents.

Nonionic surfactants can be broadly defined as compounds prepared by well-known methods of adding an alkylene oxide compound to an alcohol as shown for example in U.S. Pat. Nos. 2,677,700; 3,956,401; 4,223,163; and 4,226,736, which are hereby incorporated by reference. This process is also known as alkoxylation.

A. Ethoxylated Aliphatic Alcohols

Generally, the compounds (I) may be prepared by reacting a primary, linear, monohydric alcohol having an alkyl or olefinic group having from about 6 to about 18 carbon atoms, preferably from about 10 to about 16 carbon atoms, with ethylene oxide in amounts such that the ethylene oxide residue i.e., —($CH_2$—$CH_2$—O)—, content is on average about 3 to about 15 moles of ethylene oxide per mole of alcohol, as well as mixtures thereof. The reaction is carried out at an elevated temperature in the presence of alkaline catalysts such as the salts or hydroxides of the alkali metals or the alkaline earth metals, for example, KOH. A mixture of such alcohols may be used and this is generally true when using commercial alcohols which are often available as a blend of several alcohols. Consequently, the number of carbon atoms in the alcohol is referred to as an average number. Alternatively, the number of carbon atoms in the alcohol mixture may be referred to, for example, $C_{10/12}$. The $C_{10/12}$ designation, for example, means a mixture primarily having components with carbon residues having 10 and 12 carbon atoms with small amounts of components having carbon residues of different carbon lengths. Useful surfactants of this type include those commercially available from Huntsman Chemical Corporation, Austin, Tex., under the designations L610-3; L10-3; L1270-2; L12-3; L12-6; L24-1.3; L24-2; L24-3; and L24-4.

B. Ethoxylated Alkyl Phenols

Compounds (II) may be prepared by reacting in similar fashion alkyl phenols having an alkyl group containing from about 8 to about 12 carbon atoms in either a straight chain or branched chain configuration with ethylene oxide in amounts such that the ethylene oxide residue content is on average from about 4 to about 200 moles of ethylene oxide per mole of alkyl phenol. The alkyl substituent in such compounds may be derived from polymerized propylene, diisobutylene, octene or nonene for example. Preferred alkyl phenols include nonylphenol and octylphenol. Useful surfactants of this type include those commercially available from Huntsman Chemical Corporation, Austin, Tex., under the designations: N-120, N-100 and N-40.

C. Ethoxylated-Propoxylated Aliphatic Alcohol

Generally, the compounds (III) may be prepared by reacting in similar fashion a primary, linear or branched, monohydric alcohol having an alkyl or olefinic group having from about 6 to about 18 carbon atoms with ethylene oxide in amounts such that the ethylene oxide residue, i.e., —$CH_2$—$CH_2$—O—, content is on average about 3 to about 15 moles of ethylene oxide per mole of alcohol, as well as mixtures thereof. Following this, proxylene oxide is added in the desired amounts using the same conditions to obtain an alcohol-polyoxyethylene-polyoxypropylene reaction product. The propylene oxide residue, i.e., —$CH_2$—$CH(CH_3)$—O— and/or —$CH(CH_3)$—$CH_2$—O—, content ranges from 0 to about 30 for each type of such residue with the total averaging from about 4 to about 30.

Useful low foam, nonionic surfactants of this type include structures having the formula: R—$(EO)_x$—$(PO)_y$—H where x is on average from about 3 to about 15 with from about 5 to about 15 preferred, y is on average from about 4 to about 30 with from about 5 to about 15 preferred, and R is a linear or branched alkyl or olefinic group having from about 6 to about 18 carbon atoms with from about 6 to about 14 preferred. Useful surfactants of this type include those commercially available from Huntsman Chemical Corporation, Austin, Tex., under the designation LF-37, LF-17 and JL-80X; and from BASF Corporation, Parsippany, N.J., under the designation DW-5.

D. Propoxylated-Ethoxylated-Propoxylated Aliphatic Alcohol

Generally, the compounds (IV) may be prepared by reacting in similar fashion a primary, linear or branched, monohydric alcohol having an alkyl or olefinic group having from about 8 to about 18 carbon atoms with propylene oxide in amounts such that the propylene oxide residue, i.e., —$CH_2$—$CH(CH_3)$—O— and/or —$CH(CH_3)$—$CH_2$—O—, content ranges from 0 to about 15 for each type with the total averaging from about 2 to about 15 moles of propylene oxide per mole of alcohol, as well as mixtures thereof. Following this, ethylene oxide is added in the desired amounts using the same conditions to obtain an intermediate alcohol-propoxylate-ethoxylate reaction product. The ethylene oxide residue content is on average from about 10 to about 25 moles of ethylene oxide per mole of alcohol. Following this, propylene oxide is again added in the desired amounts using the same conditions to obtain an alcohol-propoxylate-ethoxylate-propoxylate reaction product. This propylene oxide residue content ranges from 0 to about 55 for each type with total averaging from about 10 to about 55 moles of propylene oxide per mole of alcohol.

Useful low foam, nonionic surfactants of this type include structures having the formula: R—$(PO)_z$—$(EO)_x$—$(PO)_y$—H where z is on average from about 2 to 15 with from about 3 to 15 preferred, x is on average from about 10 to about 25 with from about 11 to about 20 preferred, y is on average from about 10 to about 55 with from about 13 to about 25 preferred, and R is a linear or branched alkyl or olefinic group having from about 6 to about 18 carbon atoms with from about 6 to about 14 preferred.

Useful surfactants of this type include those commercially available from Huntsman Chemical Corporation, Austin, Tex., under the designation LF-0312A and from Olin Corporation, New Haven, Conn., under the designation Poly-Tergent SLF-18 which according to U.S. Pat. Nos. 4,464,281 and 4,973,419 has the structure $C_{6/10}$—$(PO)_3$—$(EO)_{12}$—$(PO)_{16}$—H.

A preferred embodiment of the present invention includes a compatible surfactant mixture of (a) about 39 to about 42 wt. % $C_{10/12}$—O—$(EO)_8$—$(PO)_{9.5}$—H and (b) about 58 to about 61 wt. % $C_{12/14}$—O—$(EO)_4$—H.

Detergency Builder Material

Compositions of the invention contain from about 20% to about 95%, preferably from about 40% to about 90%, by weight of detergency builder component, or mixtures thereof, said percentages being determined on an anhydrous basis although the builders can be hydrated.

The detergency builder material can be any of the detergent builder materials known in the art which include trisodium phosphate, tetrasodium pyrophosphate, sodium tripolyphosphate, sodium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrolotriacetate, sodium carboxymethyloxysuccinate, sodium carboxymethyloxymalonate, polyphosphonates, polymeric carboxylates such as polyacrylates, and mixtures thereof. Preferably, monomeric organic detergency builder materials comprise not more than about 10% of the composition by weight.

Preferred detergency builder materials have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium carbonate is a preferred precipitation detergency builder, particularly when it is desirable to reduce the total phosphorous level of the compositions of the invention. Chlorinated trisodium orthophosphate can act as both a chlorine bleach and a precipitation detergency builder material.

The inclusion of water-soluble silicates, especially sodium silicates having $SiO_2$:$Na_2O$ weight ratios of from about 1:1 to about 3.6:1 is a particularly preferred embodiment of the invention. Such silicates are a source of alkalinity useful in the automatic dishwashing process and also act to inhibit the corrosion of aluminum, glassware and ceramic glazes.

Particularly preferred compositions of the invention contain from about 15% to about 50% sodium tripolyphosphate, from about 5% to about 40% of sodium silicate solids as described hereinbefore and from 0% to about 40% sodium carbonate by weight.

Bleaching Agents

A wide variety of bleaching agents may be employed for use in the compositions of the present invention. Both halogen and peroxygen type bleaches are encompassed by this invention. Such bleaches are well-known. See for example U.S. Pat. Nos. 4,188,305; 4,464,281; and 4,601,844, which are hereby incorporated by reference.

Among the suitable halogen donor bleaches are heterocyclic N-bromo and N-chloro imides such as trichlorocyanuric, tribromocyanuric, dibromo- and dichlorocyanuric acids, and salts thereof with water-solubilizing cations such as potassium and sodium. An example of the hydrated dichlorocyanuric acid is Clearon CDB56, a product manufactured by Olin Corporation. Such bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66" indicating the parts per pound of available chlorine) which comprises a mixture of potassium dichloroisocyanurate (4 parts) and trichloroisocyanurate acid (1 part).

Other N-bromo and N-chloro iraides may also be used such as N-brominated and N-chlorinated succinimide, malonimide, phthalmide and naphthalimide. Other compounds include the hydantoins, such as 1,3-dibromo and 1,3-dichloro-5,5-dimethylhydantoin, N-monochloro-5,5-dimentylhydantoin; methylenebis(N-bromo-5,5-dimethylhydantoin); 1,3-dibromo and 1,3-dichloro 5,5-isobutylhydantoin; 1-3,dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

The hypohalite liberating agent may, if desired, be provided in a form of a stable solid complex or hydrate. Examples include sodium p-toluene-sulfo-bromoaminetrihydrate, sodium benzene-sulfo-chloroamine-dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Other sources of available chlorine which can be used are: N,N'-dichlorobenzoylene urea; paratoluene sulfoadichloroamide; N-chloroammeline; N,N'-dichloroazodicarbonamide; N-chloroacetyl urea; N,N'-dichlorobiuret; and chlorinated dicyandiamide.

Preferred chlorinating agents include potassium and sodium dichloroisocyanurate dihydrate, chlorinated trisodium phosphate and calcium hypochlorite. Particularly preferred are the organic chlorine bleaches such as sodium and potassium dichlorocyanurates, particularly sodium or potassium dichloroisocyanurate dihydrate.

Desirably, at least 0.1% available chlorine based on the weight of the detergent composition should be used. It has been found that automatic dishwashing compositions which have a source of available chlorine in an amount sufficient to provide available chlorine preferably equal to about 0.1% to about 5%, more preferably from about 0.5% to about 4%, by weight of the composition is used. A more preferred level is from about 1.25% to about 3% by weight of the composition. Hypohalite liberating compounds may generally be employed in automatic dishwashing detergents at a level of from 0.5 to 5% by weight, preferably from 0.5 to 3%. A high level of available chlorine provides improved cleaning, especially on starch soils, and improved spotting/filming.

For granular compositions, an inorganic chlorine bleach ingredient such as chlorinated trisodium phosphate and organic chlorine bleaches such as the chlorocyanurates can be utilized. Sodium hypochlorite and other alkali metal hypochlorites can be used in aqueous liquid or gel compositions.

Methods of determining "available chlorine" for compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

Although it is preferred to have a source of available chlorine present, acceptable products can be formulated without any such source. In the case of peroxygen bleaching agents, it is desirable to have enzymes present. Among the oxygen bleaches which may be included in the invention are alkali metal and ammonium salts of inorganic peroxygen compounds such as perborates, percarbonates, persulfates, dipersulfates and the like. Generally the inorganic oxygen compound will be used in conjunction with an activator such as TAED (tetraacetyl ethylene diamine), sodium benzoyl oxybenzene sulfonate or choline sulfophenyl carbonate or a catalyst such as manganese or other transition metal, as is well known in the bleaching art. Insoluble organic peroxides such as diperoxydodecanedioic acid (DPDA) or lauroyl peroxide may also be used. Generally, the peroxygen compounds are present at a level of from 0.5 to 20% by weight, 0.005 to 5% catalyst and 1 or 0.5 to 30% activator.

Alkyl Phosphate Ester

The automatic dishwashing compositions of the invention can optionally contain up to about 50%, preferably from about 2% to about 20%, based on the weight of ethoxylated nonionic surfactant of alkyl phosphate ester or mixtures thereof and wherein the alkyl preferably contains from about 16 to about 20 carbon atoms.

Suitable alkyl phosphate esters are disclosed in U.S. Pat. No. 3,314,891 issued to Schmoka et al., incorporated herein by reference.

The preferred alkyl phosphate esters contain from 16–20 carbon atoms. Highly preferred alkyl phosphate esters are monostearyl acid phosphate and monooleyl acid phosphate, or salts thereof, particularly alkali metal salts, or mixtures thereof.

The alkyl phosphate esters of the invention have been used to reduce the sudsing of detergent compositions suitable for use in automatic dishwashing machines. The esters are particularly effective for reducing the sudsing of compositions comprising nonionic surfactants which are heteric ethoxylated-propoxylated or block polymers of ethylene oxide and propylene oxide.

Other Ingredients

In addition to the above ingredients, it may be desirable, if the product sudses too much, to incorporate one of the many suds-suppressing ingredients disclosed in the above mentioned patents which have been incorporated by reference at a level of from about 0.001% to about 10%, preferably from about 0.05% to about 3%. The preferred suds suppressing materials are mono- and distearyl acid phosphates; the self-emulsified siloxane suds-suppressors for example, as disclosed in U.S. Pat. No. 4,136,045 issued to Gault et al., and mixtures thereof. In general, lower amounts of, or no, suds-suppressors are preferred. Less than 0.2%, preferably less than 0.1% is desirable, more preferably none for best spot/film, long term.

Enzymes are also desirable in compositions which do not contain a source of available chlorine. Suitable enzymes are those disclosed in U.S. Pat. No. 3,519,379 issued to Blomeyer et al.; U.S. Pat. No. 3,655,568 issued to Zaki et al.; U.S. Pat. No. 4,101,457 issued to Place et al.; and U.S. Pat. No. 4,188,305 issued to Halas, all of said patents being incorporated herein by reference.

China protecting agents including sodium or potassium aluminosilicates, aluminates, etc. may be present in amounts of from about 0.1% to about 5%, preferably from about 0.5% to about 2%.

Filler materials can also be present including sucrose, sucrose esters, sodium chloride, sodium sulfate, etc. in amounts of from about 0.001% to about 60%, preferably from about 5% to about 30%.

Hydrotrope materials such as sodium benzene sulfonate, sodium toluene sulfonate, sodium cumene sulfonate, etc. can be present in minor amounts.

Dyes, perfumes, crystal modifiers and the like can also be added in minor amounts.

Granular Compositions

The compositions of the invention are not restricted as to manner of preparation. The granular compositions can be prepared in any manner, including dry mixing, that results in formation of a granular product form. The process described in U.S. Pat. No. 2,895,916, issued to Milenkevich et al., and variations thereof, are particularly suitable. Also suitable are the processes described in U.S. Pat. No. 4,077,897, issued to Gault; U.S. Pat. No. 4,169,806, issued to Davis et al.; U.S. Pat. No. 4,182,683, issued to Irvine et al.; U.S. Pat. No. 4,207,197, issued to Davis et al.; and U.S. Pat. No. 4,427,417, issued to Parasik. These six patents are incorporated herein by reference.

Liquid Compositions

Liquid compositions are disclosed in U.S. Pat. No. 4,116,851, issued to Rupe et al.; U.S. Pat. No. 4,226,736, issued to Bush et al.; U.S. Pat. No. 4,431,559, issued to Ulrich; U.S. Pat. No. 4,511,487, issued to Pruhs et al.; U.S. Pat. No. 4,512,908, issued to Heile; Canadian Pat. No. 1,031,229—Bush et al.; European Patent Application No. 0130678—Heile, published Jan. 9, 1985; European Patent Application 0176163—Robinson, published Apr. 2, 1986; U.K. Patent Application GB No. 2,116,199A—Julemont et al., published Sep. 21, 1983; U.K. Patent Application GB No. 2,140,450A—Julemont et al., published Nov. 29, 1984; U.K. Patent Application GB No. 2,163,447A—Colarusso, published Feb. 26, 1986; and U.K. Patent Application GB No. 2,164,350A—Lai et al., published Mar. 19, 1986. All of said patents and said published applications are incorporated herein by reference.

Such aqueous thickened compositions comprise:

(1) from about 0.1% to about 5%, preferably from about 0.1% to about 2.5% of a bleach-stable, compatible surfactant mixture of the present invention;

(2) from about 5% to about 40%, preferably from about 15% to about 30% of a detergency builder, especially a builder selected from the group consisting of sodium tripolyphosphate, sodium carbonate, potassium pyrophosphate and mixtures thereof;

(3) a hypochlorite bleach to yield available chlorine in an amount from about 0.3% to about 20.0%, preferably from about 0.5% to about 1.5%;

(4) from about 0.1% to about 10%, preferably from about 0.5% to about 5% of a thickening agent, preferably a clay thickening agent or a cross-linked water insoluble polycarboxylate agent;

(5) alkali metal silicate to provide from about 3% to about 15%, preferably from about 5% to about 12.5% of $SiO_2$;

(6) about 0.1 to about 0.5% of a physical stabilizer such as a fatty acid or soap; and (7) the balance an aqueous liquid.

Hard surface cleaning compositions of all types which contain dyes can be formulated including granular and liquid scouring cleansers of the type described in U.S. Pat. No. 3,583,922, issued to McClain et al.; U.S. Pat. No. 4,005,027, issued to Hartman; U.S. Pat. No. 4,051,055, issued to Trinh et al.; and U.S. Pat. No. 4,051,056, issued to Hartman, all of said patents being incorporated herein by reference.

Compositions for cleaning toilets including automatic products such as disclosed in U.S. Pat. No. 4,208,747, issued to Dirksing, incorporated herein by reference, can be formulated.

EXAMPLES

Comparative testing of the surfactants and mixtures thereof was carried out according to the testing procedure mentioned in "Deposition on Glassware During Mechanical Dishwashing" CSMA Designation DCC-05A December 1981 as published in Detergents Division Test Methods Compendium, Second Edition, December 1985 by the Chemical Specialties Manufacturers Association, Inc. except that we carried out our testing in both machines to minimize machine to machine differences.

In the examples, a WIN occurs when one test composition demonstrates better film or spot performance than the composition it is being compared against. This test method helps to clearly differentiate experimental results.

FOOD SOIL COMPOSITION AND PREPARATION

A. Cook, for five minutes after the mixture starts to boil, a mixture of dry wheat cereal (90 g. of Hodgson Mill All Natural Unprocessed Wheat Bran) and 310 g. of deionized water. After the five minute boil, let the cooked mass cool, and remove the excess water by filtration through a large Buchner funnel.

B. Into the stainless steel mixing bowl of a Hobart mixer, slice approximately 900 g. (a two pound box of margarine sticks) of margarine. Place the bowl into a 37°–39° C. water bath in order to melt the margarine.

C. After the margarine has melted (about 90 minutes) remove the bowl from the water bath and add to the melted margarine 225.8 g. of non-fat, instant powdered milk. Mix the milk into the melted margarine. Next add 167.0 g. of the cooked wheat cereal to the margarine-powdered milk mixture. Mix the liquified food soil with the Hobart mixer until it becomes slightly stiff from cooling.

D. For storage, transfer the test soil to aluminum foil cups (aluminum weighing boats). Into each cup place 40–41 g. of the soil mixture. Place the individual containers onto a tray and place the tray into a refrigerator for storage.

SPOT/FILM TEST PROCEDURE

I. The Preparation of Test Glasses

A. Load as many glasses as possible in the top rack of automatic dishwashing machine No. 1 and set the cycle selector to "Light/China."

1. Wash the glasses with Cascade by filling each of the two machine detergent cups with the Cascade.
2. After the Cascade wash, wash with citric acid by adding to each machine detergent cup 60 g. of citric acid.
3. Add a small amount of hard water only during the first wash and the main wash of each "Light/China" cycle.

B. Select the twenty best glasses for use in the test run.

C. Do a baseline spot/film evaluation on the twenty selected glasses. Then using the baseline scores, distribute the test glasses between the two automatic dishwashing machines in such a manner that will insure that the Spot/Film baseline totals for the two machines will match within one unit for the spot category and for the film category.

II. Test Run; Initiation of Round 1

Remove the food soil from the refrigerator. To preheat the system and machines, stagger start both machines on the light/china setting. Let each machine run through at least the main wash period before stopping them. Use only the deionized water from the hot water system for this warm-up. This operation warms up the dishwashers, the dishes etc. in the machines and equalizes the temperature in the hot water system.

A. Start operations with machine No. 1. Spread the food soil, about 40 g. to 41 g. per run, placing an approximately equal amount on each of six dinner plates.

B. Add thirty-eight grams of test detergent "1" to the machine door detergent cup that will be closed (the closed cup) and thirty grams of test detergent "1" to the machine door detergent cup that will remain open (the open cup). Close and latch the machine door.

C. Set machine No. 1 cycle selector to the light/china setting.

D. Start the test and record the data on the run data sheet.

E. While machine No. 1 is running in its main test wash period, prepare machine No. 2 for operation. Apply the food soil as before to six dinner plates from machine No. 2 and add test detergent "2" samples to the detergent cups in the door of machine No. 2.

F. After machine No. 1 has completed all wash and rinse periods, start machine No. 2.

G. Start machine No. 2 on the light/china setting and record all data on the run data sheet.

H. Open machine No. 1, after it has been on the dry period for at least ten minutes, and switch the test glasses within the upper rack as follows:

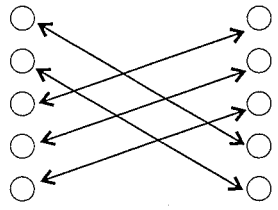

I. During the main wash period of machine No. 2, prepare machine No. 1 for its second run of this round by adding new food soil to the dinner plates and fresh test detergent "1" to the detergent cups in the machine door according to the above methods.

J. When machine No. 2 finishes its first run of this round:

1. Start machine No. 1 in a like manner as above for its second run of this round.
2. Make machine No. 2 ready for operation in a like manner as above.

K. When machine No. 1 finishes its second run, start machine No. 2 for the second, and last, time of this round.

L. After machine No. 2 finishes the second run, open both machines and let all glasses air dry for one to two hours.

M. Place the test glasses 1–10 in a mixed order, five from each machine, into a light box for evaluation. Note: the use of a light box, which is constructed with fluorescent lights to give edge lighting of the glasses, is made for critical examination for spots and film. Place glasses 11–20 on top of the light box, five from each machine in the same order by machine as those in the light box. All glasses are now out of the two machines.

N. Evaluate the glasses on a scale of 0 to 10. Each glass is individually scored for both spot and film formation. A score of 0 means no spots or no film. A score of 10 means complete and heavy coverage of the glass by spots or film respectively.

O. Round 1 is now complete.

III. Setup for Round 2

A. Switch glass and dish sets from machine No. 1 to machine No. 2 and vice versa. Switch detergents also as the detergent used stays with the same glass/dish set throughout the entire test.

B. With the glasses (and silverware if desired) removed from the machines, stagger start both machines on the light/china setting for a warm-up cycle. Use deionized water only, and use no detergent.

IV. Initiate Round 2

After 30 minutes, stop the machines if they have not yet stopped on their own.

A. Return the glasses (and silverware if it was removed) to the appropriate machine.

B. Make machine No. 1 ready to go as described above.

C. Run two runs for each machine as described above in Round 1.

D. Let the glasses dry in the machines as above.

V. Round 2 Evaluation and Round 3 Initiation

A. Remove the glasses from the machines and place them into the light box in a like manner as described above. Complete the evaluation of the glasses. Round 2 is now complete.

1. While evaluating the glasses, run both machines to preheat them and equilibrate the system. Use only deionized water for this procedure and set the machines for a staggered start on the light/china setting.

B. After all of the glasses have been evaluated and after any appropriate machine drain cycle, shut off both machines.

C. Switch glass racks, silverware racks, and dish sets from machine No. 1 to machine No. 2 and vice versa.

D. Replace the glasses into their appropriate machine, remembering the switch that needs to be made.

E. Proceed as stated above until round 3 and round 4 have been completed.

VI. Test Conclusion

A. Make the last evaluation of the test glasses.

AUTOMATIC DISHWASHING DETERGENT PREPARATION

In each of the following Examples, the identified surfactant(s) were formulated into an automatic dishwashing detergent prepared as follows.

Into a mixer bowl place in the order listed the following materials:

| | | |
|---|---|---|
| 1. | Sodium Carbonate, lite, granular | 76 g. |
| 2. | Sodium Sulfate, anhydrous, granular | 287 g. |
| 3. | STPP $H_2O$, granular | 150 g. |
| 4. | STPP, anhydrous, granular | 375 g. |
| 5. | Britesil C-24 | 105 g. |
| 6. | Test Surfactant or surfactant mixture | 31 g. |

Britesil $C_{24}$ is an anhydrous sodium polysilicate having a silica-to-alkali ($SiO_2$:$Na_2O$) weight ratio of 2.4 and is available from The PQ Corporation, Valley Forge, Pa. STPP is sodium tripolyphosphate.

The surfactant is spread on top of the mixed powders (1–5) using a dropper and then mixed into the powders using a spatula or a large spoon. Place the bowl onto a mixer and mix the bowl contents for about 15 minutes.

Next, to the above mixture add 315 grams of Silicate M® solution. Silicate M® solution is a sodium silicate solution available from The PQ Corporation, Valley Forge, Pa. Perform the addition slowly in a dropwise fashion.

During the addition, constantly mix the bowl contents with the mixer.

When the Silicate M® solution addition is finished, stop mixing, scrape the bowl sides/mixer blades and break up all lumps that have formed. Resume mixing for five to ten minutes.

Finally, add to the test automatic dishwashing detergent formulation approximately 89 grams of deionized water. Add the deionized water in a dropwise fashion, with mixing in a fashion similar to that used to add the Silicate M® solution above.

Layer the mixture onto a large plastic tray and leave it at ambient conditions overnight to dry. After drying, remove the large lumps of detergent before use in the testing procedure by using a No. 8 sieve (ASTM-11 spec. screen).

To the test detergent prepared as described above, CDB Clearon® compound is added at a rate of 0.042 grams per gram of test detergent (1.25 g. of CDB Clearon® compound per 30 g. of test detergent or 1.60 g. of CDB Clearon® compound per 38 g. of test detergent). This CDB Clearon® compound post addition is best accomplished the day of the test. CDB Clearon® compound is a sodium dichloro-s-triazinetrione dihydrate available from Olin Corporation.

| Test Formulation | | |
|---|---|---|
| Sodium Carbonate | 76 g. | (5.3%) |
| Sodium Sulfate | 287 g. | (20.1%) |
| STPP.$H_2O$ | 150 g. | (10.5%) |
| STPP, anhydrous | 375 g. | (26.3%) |
| Britesil C-24 ® | 105 g. | (7.4%) |
| Test Surfactant or Surfactant Mixture | 31 g. | (2.1%) |
| Silicate M ® | 315 g. | (22.1%) |
| Deionized Water | 89 g. | (6.2%) |
| CDB Clearon ® | Post Add | |

As used herein, all percentages, parts and ratios are by weight unless otherwise stated.

Where indicated, the following nonionic surfactants (Table I) were used in the following Examples:

TABLE I

| Surfactant | Structure | Mol. Weight | Alcohol Used |
|---|---|---|---|
| A | $C_{6/10}$—$(EO)_3$—H | 276 | I |
| B | $C_{10}$—$(EO)_3$—H | 290 | II |
| C | $C_{12}$—$(EO)_2$—H (70%) | 326 | III |
| D | $C_{10/12}$—$(EO)_3$—H | 395 | IV |
| E | $C_{10/12}$—$(EO)_6$—H | 436 | IV |
| F | $C_{10/12}$—$(EO)_8$—H | 524 | IV |
| G | $C_{12/14}$—$(EO)_{1.3}$—H | 255 | V |
| H | $C_{12/14}$—$(EO)_2$—H | 286 | V |
| I | $C_{12/14}$—$(EO)_3$—H | 330 | V |
| J | $C_{12/14}$—$(EO)_4$—H | 372 | V |
| K | $C_{12/14}$—$(EO)_{6.5}$—H | 484 | V |
| L | $C_{12/14}$—$(EO)_7$—H | 487 | V |
| M | $C_{12/14}$—$(EO)_9$—H | 575 | V |
| N | $C_{12/14}$—$(EO)_{12}$—H | 707 | V |
| O | $C_{14/16}$—$(EO)_7$—H | 532 | VI |
| P | $C_{10/12}$—$(EO)_4$—$(PO)_{1.5}$—$(EO)_4$—H | 603 | IV |
| Q | Np—$(EO)_{12}$—H | 748 | NpOH |
| R | Np—$(EO)_{10}$—H | 660 | NpOH |
| S | Np—$(EO)_4$—H | 572 | NpOH |
| T | $C_{10/12}$—O—$(EO)_8$—$(PO)_{9.5}$—H | 1036 | IV |
| U | $C_{6/10}$—O—$(PO)_3$—$(EO)_{12}$—$(PO)_{20}$—H | 2006 | I |
| V | $C_{12/14}$—O—$(EO)_9$—$(PO)_9$—H | 1117 | V |
| W | $C_{12/14}$—O—$(EO)_8$—$(PO)_4$—H | 783 | V |

The foregoing surfactants were prepared by appropriately alkoxylating the following alcohols using KOH as a catalyst.

TABLE II

| Alcohol Used | Commercially Available as[a] | Typical Alcohol Composition by Weight % | | | | | | |
|---|---|---|---|---|---|---|---|---|
| | | $C_6$ | $C_8$ | $C_{10}$ | $C_{12}$ | $C_{14}$ | $C_{16}$ | $C_{18}$ |
| I | EPAL-610 | 4.3 | 42 | 53.6 | 0.1 | — | — | — |
| II | EPAL-10 | | | 99.4[b] | | | | |
| III | EPAL-12/70 | — | — | 0.5 | 69.5 | 29 | 1 | — |
| IV | EPAL 1012 | 0.2 | 1.8 | 75 | 22.8 | 0.2 | — | — |
| V | EPAL 1214 | — | — | — | 66.3 | 26.6 | 7.1 | — |
| VI | EPAL 1416 | — | — | — | 0.3 | 62.4 | 35.9 | 1.4 |

[a]Commercially available linear alcohols from Ethyl Corporation, Baton Rouge, LA.
[b]No other components identified.

"NpOH" stands for nonyphenol. Np is the carbon residue of nonylphenol.

The following Examples illustrate the nature of the invention and facilitate its understanding, but are not intended to be limitative. Reference is also made to the foregoing surfactants by their corresponding letter designation.

EXAMPLES 1–6

U vs. U+E

The test ratio of U:E was 1:0.87 wt ratio which is a 20:80 mole ratio. In the ability to defoam the test soil mixture, surfactant U was a better defoamer by 3.3 to 11.0% (depending upon the dishwasher used for the evaluation). The average defoaming difference was 5.6 to 9.2% favoring surfactant U. Surfactant U won a total of eleven (11 ) evaluations when both categories of spot and film were evaluated while the mixture U+E won fifteen (15) evaluations. The results of the spot/film tests are given in Table III.

TABLE III

| Example | U | | MIXTURE (U + E) | |
|---|---|---|---|---|
| | Film | Spot | Film | Spot |
| 1 | 296.5 | 242.5 | 216.0 | 245.5 |
| 2 | 186.5 | 188.0 | 121.0 | 132.5 |
| 3 | 306.0 | 305.5 | 367.5 | 340.5 |
| 4 | 432.0 | 371.0 | 364.5 | 352.0 |
| 5 | 329.5 | 287.5 | 339.0 | 293.5 |
| 6 | 408.5 | 359.0 | 423.0 | 357.5 |
| Total | 1959.0 | 1753.5 | 1831.0 | 1721.5 |
| Avg./glass | 2.8 | 2.5 | 2.7 | 2.5 |

EXAMPLE 7

U vs. U+E

The test ratio of U:E was a 1:2.1 weight ratio which is a 9.5:90.5 mole ratio. As Table IV depicts, the mixture was of equal performance to surfactant U. The mixture (U+E) had lost about 10% in defoaming.

TABLE IV

| Example | U | | MIXTURE (U + E) | |
|---|---|---|---|---|
| | Film | Spot | Film | Spot |
| 7 | 128.5 | 131.5 | 144.0 | 144.0 |
| Avg./glass | 1.6 | 1.6 | 1.8 | 1.8 |

EXAMPLES 8–12

T vs. T+E

The test ratio of T:E was a 1:1.7 weight ratio (or 37.3 and 62.7 wt % respectively) which is a 20:80 mole ratio. In the ability to defoam the test soil mixture, surfactant T was a better defoamer by 5 to 7% (average values) than the mixture. The lower cost mixture of surfactants T and E (20 mole %: 80 mole %) afforded equivalent spot/film performance to surfactant T. Considering both the spot and film categories, surfactant T won evaluation sessions, while the mixture (T+E) won 13 evaluation sessions. The spot/film test results are given in Table V.

TABLE V

| Example | T | | MIXTURE (T + E) | |
|---|---|---|---|---|
| | Film | Spot | Film | Spot |
| 8 | 392.5 | 419.5 | 400.0 | 347.0 |
| 9 | 260.0 | 234.0 | 312.5 | 254.0 |
| 10 | 345.0 | 325.5 | 333.0 | 350.5 |
| 11 | 387.0 | 333.0 | 344.5 | 351.0 |
| 12 | 436.0 | 362.0 | 311.0 | 271.5 |
| Total | 1820.5 | 1674.0 | 1701.0 | 1574.0 |
| Avg./glass | 3.1 | 2.9 | 3.0 | 2.8 |

EXAMPLES 13–15

T vs. T+L

The mixture ratio of surfactant T to surfactant L was a 1:1..9 weight ratio (or 33.4 and 66.6 wt % respectively) which equals a 20:80 mole ratio. Although the mixture was equivalent to surfactant T for the prevention of spots, it was inferior to surfactant T for the prevention of film formation.

Surfactant T consistently outperformed the mixture in the area of defoaming by 16–19% (based on spray arm revolutions). This was a noticeable drop in defoaming performance.

It was also very obvious to the naked eye that the defoaming performance of the mixture was inferior to that of surfactant T. When the dishwasher door was opened during a wash cycle, the machine using the mixture was full of foam while the machine using surfactant T contained little foam. Thus, it was not surprising that the cleaning performance for this mixture was at a lower level. The spot/film test results are given in Table VI.

TABLE VI

| | T | | MIXTURE (T + L) | |
|---|---|---|---|---|
| Example | Film | Spot | Film | Spot |
| 13 | 427.5 | 453.5 | 627.0 | 484.0 |
| 14 | 271.0 | 266.5 | 324.0 | 216.0 |
| 15 | 511.5 | 421.5 | 551.5 | 482.5 |
| Total | 1210.0 | 1141.5 | 1502.5 | 1182.5 |
| Avg./glass | 3.2 | 3.0 | 4.0 | 3.1 |

EXAMPLE 16

T vs. T+L

The mixture ratio of surfactant T to surfactant L was a 1:1.9 weight ratio (or 33.4 and 66.6 wt % respectively) which equals a 20:80 mole ratio. In this experiment, an even more severe test of defoaming ability was performed. It was carried out under heavy stress conditions including high food soil and high foaming food soils. For this test, the food soils consisted of our usual mixture plus a heavy charge of oatmeal with mixed greens and one-half of a raw medium egg (per wash cycle). Under these test conditions, the defoaming ability of surfactant T fell only 11%. Thus, the surfactant T was a better defoamer than the mixture (T+L) by a level of 24–33% under these test conditions.

During this more severe test, the ability of both surfactant T and the mixture (T+L) to prevent spot and film formation fell by a large amount. But now surfactant T clearly outperformed the mixture in both spot and film prevention. The spot/film test results are given in Table VII.

TABLE VII

| | T | | MIXTURE (T + L) | |
|---|---|---|---|---|
| Example | Film | Spot | Film | Spot |
| 16 | 179.5 | 232.0 | 219.0 | 275.5 |
| Avg./glass | 4.5 | 5.8 | 5.5 | 6.9 |

EXAMPLES 17–18

T vs. T+L

The mixture ratio of T:L was 66.7:33.3 weight ratio or 50:50 mole ratio. After evaluations, we concluded that the performance for the mixture (T+L) was definitely inferior. The defoaming performance was much better than that noted previously for the 20:80 mole mixture. However, surfactant T still had a better defoaming score by 2.6–6.8%. This was not a significant difference. The foam observed in the machines dropped significantly, relative to that observed for the 20:80 mole ratio mixture. Machine foam generation was now back near that of surfactant T alone. The spot/film results are given in Table VIII.

TABLE VIII

| | T | | MIXTURE (T + L) | |
|---|---|---|---|---|
| Example | Film | Spot | Film | Spot |
| 17 | 391.0 | 432.0 | 641.0 | 519.5 |
| 18 | 462.0 | 362.5 | 532.5 | 410.5 |

TABLE VIII-continued

| | T | | MIXTURE (T + L) | |
|---|---|---|---|---|
| Example | Film | Spot | Film | Spot |
| Total | 835.0 | 794.5 | 1173.5 | 930.0 |
| Avg./glass | 3.6 | 3.3 | 4.9 | 3.9 |

EXAMPLE 19

Two mixtures within the scope of the present invention were prepared and compared to each other. The first surfactant mixture was T:E. The second surfactant mixture was W:E. The test molar ratio was 20:80. The spot/film test results are given in Table IX.

TABLE IX

| | MIXTURE 1 (T + E) | | MIXTURE 2 (W + E) | |
|---|---|---|---|---|
| Example 19 | Film | Spot | Film | Spot |
| Avg./glass | 2.9 | 2.5 | 2.7 | 2.4 |

The two mixtures afforded equivalent performances.

EXAMPLES 20–21

T VS. T+J

The mixture ratio of T:J was about 40:60 wt. ratio or 20:80 mole ratio. As seen by the following film and spot results, the mixture (T+J) outperformed or was equivalent to surfactant T. However, surfactant T still had a better defoaming score by 1.8–7.8% in Example 20 and 6.9–7.4% in Example 21. This was not a significant difference. The spot/film test results are given in Table X.

TABLE X

| | T | | MIXTURE (T + J) | |
|---|---|---|---|---|
| Example | Film | Spot | Film | Spot |
| 20 | 447.0 | 361.5 | 250.0 | 250.0 |
| Avg./glass | 3.7 | 3.0 | 2.1 | 2.1 |
| 21 | 552.0 | 596.0 | 595.5 | 411.5 |
| Avg./glass | 3.1 | 3.3 | 3.3 | 2.3 |

EXAMPLE 22

COMPATIBLE MIXTURES

The "compatible" mixtures of nonionic surfactants useful in the present invention are determined by mixing at ambient conditions 20 mole % of a propylene oxide capped nonionic surfactant (structures III and IV) and 80 mole % of an ethoxylated nonionic surfactant (structures I and II). For each sample, total sample weight was about 100 grams. In the present disclosure and appended claims, if such a mixture is clear, the mixture of such surfactants is compatible. If the mixture is cloudy, contains precipitates or undissolved surfactant (if solid), the mixture is not within the scope of the present invention.

TABLE XI

| COMPATIBILITY TEST | | |
|---|---|---|
| | 80 Mole % Surfactant With 20 Mole % Surfactant T | |
| Surfactant | Clear | Cloudy |
| A | X | |
| B | X | |
| C | X | |
| D | X | |
| E[a] | X | |
| F | | X |
| G | X | |
| H | X | |
| I | X | |
| J[a] | X | |
| K | | X |
| L[a] | | X |
| M[b] | | X |
| N[b] | | X |
| O[b] | | X |
| P | X | |
| Q | X | |
| R | X | |
| S | X | |

[a]Dishwasher Tested
[b]Solid at Ambient Temperature

The compatibility test is indicative of the combinations of nonionic surfactants suitable in the present invention. For example, a mixture of surfactants T and J was clear and performed satisfactorily. On the other hand, a mixture of surfactants T and L was cloudy and did not perform satisfactorily.

We claim:

1. In a machine dishwashing composition, a nonionic surfactant mixture comprising:

(a) at least one first nonionic surfactant selected from the group consisting of nonionic surfactants having the formula (I)

$$R^1—O—(CH_2CH_2O)_y—H \quad (I)$$

wherein $R^1$ represents a linear alkyl or olefinic group having from about 6 to about 18 carbon atoms and y represents a number ranging from about 3 to about 15, and the formula (II)

$$Np—O—(CH_2CH_2O)_z—H \quad (II)$$

wherein Np is the carbon residue of nonylphenol or octylphenol and z represents a number ranging from about 4 to about 200; and (b) at least one second nonionic surfactant having the formula (IV)

$$R^3—O—A^2—(CH_2CH_2O)_n—A^3—H \quad (IV)$$

wherein $R^3$ represents a linear or branched alkyl or olefinic group having from about 6 to about 18 carbon atoms, n represents a number ranging from about 10 to about 25, $A^2$ represents a group having the formula $—(CH_2—CH(CH_3)—O)_t—$, $—(CH(CH_3)—CH_2—O)_u—$ or a combination thereof with t and u each representing a number ranging from 0 to about 15 and the sum of t and u represents a number ranging from about 2 to about 15, and $A^3$ represents a group having the formula $—(CH_2—CH(CH_3)—O)_v—$, $—(CH(CH_3)—CH_2—O)_w—$ or a combination thereof with v and w each representing a number ranging from 0 to about 55 and the sum of v and w represents a number ranging from about 10 to about 55, wherein the at least one first surfactant and the at least one second surfactant are compatible with each other.

2. The mixture of claim 1, wherein the at least one first surfactant and the at least one second surfactant are present in a molar ratio ranging from about 95:5 to about 60:40.

3. A low foaming machine dishwashing composition comprising:

(a) at least one first nonionic surfactant selected from the group consisting of nonionic surfactants having the formula (I)

$$R^1—O—(CH_2CH_2O)_y—H \quad (I)$$

wherein $R^1$ represents a linear alkyl or olefinic group having from about 6 to about 18 carbon atoms and y represents a number ranging from about 3 to about 15, and the formula (II)

$$Np—O—(CH_2CH_2O)_z—H \quad (II)$$

wherein Np is the carbon residue of nonylphenol or octylphenol and z represents a number ranging from about 4 to about 200;

(b) at least one second nonionic surfactant having the formula (IV)

$$R^3—O—A^2—(CH_2CH_2O)_n—A^3—H \quad (IV)$$

wherein $R^3$ represents a linear or branched alkyl or olefinic group having from about 6 to about 18 carbon atoms, n represents a number ranging from about 10 to about 25, $A^2$ represents a group having the formula $—(CH_2—CH(CH_3)—O)_t—$, $—(CH(CH_3)—CH_2—O)_u—$ or a combination thereof with t and u each representing a number ranging from 0 to about 15 and the sum of t and u represents a number ranging from about 2 to about 15, and $A^3$ represents a group having the formula $—(CH_2—CH(CH_3)—O)_v—$, $—(CH(CH_2)—CH_2—O)_w—$ or a combination thereof with v and w each representing a number ranging from 0 to about 55 and the sum of v and w represents a number ranging from about 10 to about 55, wherein the at least one first surfactant and the at least one second surfactant are compatible with each other;

(c) a detergency builder material; and (d) a bleaching agent.

4. The low foaming machine dishwashing composition of claim 1 further comprising an alkyl phosphate ester.

5. The low foaming machine dishwashing composition of claim 1 further comprising a suds-suppressing ingredient.

6. The low foaming machine dishwashing composition of claim 1 further comprising a china protecting agent.

7. The low foaming machine dishwashing composition of claim 1 further comprising a filler material.

8. The low foaming machine dishwashing composition of claim 1 further comprising an enzyme when said composition is devoid of a source of available chlorine.

9. The low foaming machine dishwashing composition of claim 1, wherein said composition is in the form of granules or in the form of a liquid.

* * * * *